United States Patent [19]

Downing et al.

[11] 4,168,934

[45] Sep. 25, 1979

[54] LIFT TRUCK OVERLOAD PROTECTIVE CIRCUIT HAVING OVERRIDE FEATURE

[75] Inventors: Terry R. Downing, Hazel Crest, Ill.; Allois F. Geiersbach, Milwaukee, Wis.

[73] Assignee: Allis-Chalmers Corporation, Milwaukee, Wis.

[21] Appl. No.: 868,346

[22] Filed: Jan. 10, 1978

Related U.S. Application Data

[63] Continuation of Ser. No. 645,526, Dec. 29, 1975, abandoned.

[51] Int. Cl.[2] ..... B66F 9/08

[52] U.S. Cl. ..... 414/636; 340/685

[58] Field of Search ..... 214/660, 670–674; 212/39 R, 39 B, 39 DB, 39 MS, 39 A, 39 P; 340/267 C

[56] References Cited

U.S. PATENT DOCUMENTS

| | | | |
|---|---|---|---|
| 3,497,095 | 2/1970 | Couberly | 214/674 |
| 3,631,537 | 12/1971 | Zlbolski | 212/39 MS |
| 3,638,211 | 1/1972 | Sanchez | 212/39 MS |
| 3,831,492 | 8/1974 | Young | 214/674 |
| 3,960,286 | 1/1976 | Spooner et al. | 214/674 |
| 3,993,166 | 11/1976 | Senour | 214/674 |
| 4,003,487 | 1/1977 | Downing | 214/673 |

FOREIGN PATENT DOCUMENTS

| | | | |
|---|---|---|---|
| 1258081 | 12/1971 | United Kingdom | 214/673 |

*Primary Examiner*—Trygve M. Blix
*Assistant Examiner*—R. B. Johnson
*Attorney, Agent, or Firm*—Lee H. Kaiser

[57] ABSTRACT

A fork lift truck has a safety system for inhibiting further raising of the carriage or further forward tilting of the mast when an excessive tilting moment is acting on the truck and permits override of the safety system so that the overload can be relieved by the operator under certain conditions without requiring the assistance of a second truck.

1 Claim, 1 Drawing Figure

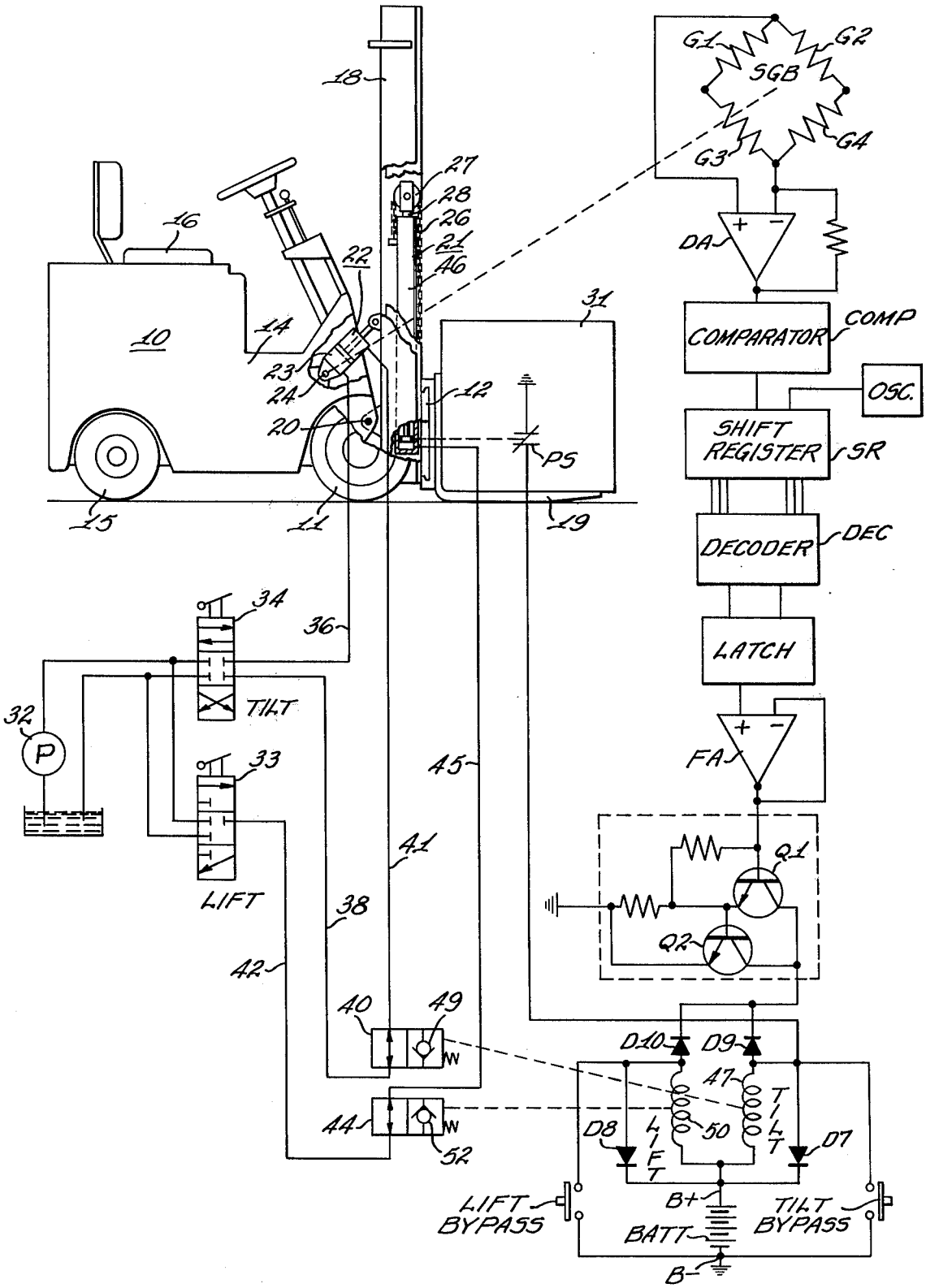
G1
G2
SGB
G3
G4
DA
COMPARATOR
COMP
OSC.
SHIFT REGISTER
SR
DECODER
DEC
LATCH
FA
Q1
Q2
D10
D9
47
50
D8
D7
LIFT BYPASS
TILT BYPASS
B+
BATT
B-
TILT
LIFT
P
32
33
34
36
38
40
41
42
44
45
49
52
P5
10
11
12
14
15
16
18
19
20
21
22
23
24
26
27
28
31
46

LIFT TRUCK OVERLOAD PROTECTIVE CIRCUIT HAVING OVERRIDE FEATURE

This is a continuation of application Ser. No. 645,526 filed Dec. 29, 1975, now abandoned.

FIELD OF THE INVENTION

This invention relates to an overload protective system for a fork lift truck which is responsive to excessive tilting moment acting on a truck, as a result of a load on the raised carriage, to disable the carriage elevating motor and the mast tilting motor and thus inhibit further raising of the carriage or further forward tilting of the mast, thereby preventing the operator from increasing the danger of overturning the truck during material handling operations.

BACKGROUND OF THE INVENTION

A safety system for a fork lift truck is disclosed in U.S. Pat. No. 4,003,487 in the name of Terry R. Downing and having the same assignee as this invention which responds to excessive overturning moment acting on the truck by operating blocking hydraulic valves to closed positions wherein they disable the carriage elevating motor so that the carriage cannot be raised further and also disable the mast tilting motor to prevent further forward tilting of the mast. The hydraulic blocking valves have check valves which permit exhaust of fluid from the carriage elevating motor so that the carriage can be lowered and also permit supply of fluid to the mast tilting motor so that the mast can be tilted backward to remove an overload. However, a load may be picked up in such a manner as to create an excessive overturning moment and trip the protective system, but not allow relief of the overload by the normal operations of lowering the carriage or backward tilting of the mast permitted by the check valves. For example, this may happen when an overload picked up by first tilting the mast backward trips the protective system and there is insufficient clearance beneath the forks to allow relief of the load by lowering the carriage. Also when picking up a load from the floor by first tilting backward, the protective system may be tripped even if the weight is relatively small if the load is supported near the fork tips and acts together with the relatively long moment arm to create an excessive tilting moment. Under such circumstances when the load is picked up by backward tilting, the protective system cannot be reset by forward tilting of the mast which is inhibited by the tripped protective system. It is sometimes necessary with such safety system to utilize a second truck to relieve the overload before the protective system can be reset so that normal material handling operations are restored. A further disadvantage of such known overload protective system is that the check valves may become clogged and inoperative due to accumulation of dirt, thereby making it impossible to lower the load or tilt the mast backward to relieve the overload.

OBJECTS OF THE INVENTION

It is an object of the invention to provide an improved overload safety system for a lift truck which overcomes the above disadvantages of prior art systems. Another object is to provide such an overload protective system for a lift truck which does not necessitate use of a second truck to relieve the overload and reset the protective system when the overload has been picked up with the mast tilted backward. Still another object is to provide such an improved overload protective system for a lift truck which permits override of the means for disabling the carriage elevating motor so that the load can be lowered by the operator even if the check valves are inoperative due to clogging. A further object is to provide such an improved overload safety system which permits override of the means for disabling the mast tilting motor to relieve an overload picked up when the mast is tilted backward even if the overload protective system is tripped or a check valve is clogged.

SUMMARY OF THE INVENTION

A lift truck has a carriage elevating motor for raising and lowering a load support carriage on a mast tiltable about a horizontal axis; a mast tilting motor for controlling the tilt of the mast; and a safety system responsive to an excessive overturning moment acting on the truck, as a result of a load on the raised carriage, to disable the carriage elevating motor and the mast tilting motor and is provided with overload relieving means for overriding the motor disabling means to permit removal of the load from the truck without the assistance of a second truck. The overload relieving means preferably is responsive to the carriage being adjacent its fully lowered position to override the means for disabling the mast tilting motor so that the mast can be straightened to relieve the overload and reset the protective system. The overload relieving means preferably also includes manually operated means for selectively overriding the means to disable the carriage elevating motor thereby permitting the load supporting carriage to be lowered to remove an overload and reset the protective system.

DESCRIPTION OF THE DRAWINGS

These and other objects and advantages of the invention will be more readily apparent from the following detailed description when considered together with the single FIGURE of the accompanying drawing which is a schematic diagram of an overload protective system for a lift truck embodying the invention, with the known system shown in block form.

DETAILED DESCRIPTION

The invention is illustrated as being incorporated in the overload protective system for a counterbalanced fork lift truck disclosed in U.S. Pat. No. 4,003,487 having the same assignee as this invention and which continuously monitors the forward overturning moment acting on a counterbalanced lift truck 10 tending to tilt the truck about its front wheels 11 as a fulcrum and is responsive to excessive tilting movement to prevent shifting of a load supporting carriage 12 in a direction which would increase the forward tilting moment. The lift truck 10 also has a main frame 14, a pair of rear steerable wheels 15, an operator's seat 16, a vertical mast 18 pivotally connected to frame 14 on a transverse axis by pins 20, a carriage elevating motor which preferably comprises a single lift jack 21 for lifting carriage 12 with forks 19, and a mast tilting motor which preferably comprises double acting hydraulic tilt jack 22 for tilting mast 18. Tilt jack 22 has a tilt cylinder 23 pivotally connected on a transverse axis to the frame 14 about a load carrying tilt jack anchor pin 24 and a piston rod pivotally connected on a transverse axis to the mast 18.

Lift jack 21 supports the carriage 12 through a chain 26 trained over a pulley 27 mounted on the top of lift jack piston 28. When a load 31 is supported on forks 19 and mast 18 is tilted, an overturning moment acts on truck 10 tending to tilt it about front wheels 11 as a fulcrum, and such overturning movement is resisted by tilt jack 22 and tilt jack anchor pin 24, whereby pin 24 is subjected to mechanical stress which is proportional to the tilting moment acting on the truck 10.

The hydraulic control system for carriage elevating motor 21 and mast tilting motor 22 may include a pump 32; manually operable lift and tilt control valves 33 and 34; a tilt cylinder supply conduit 36 connecting the manual tilt control valve 34 with the closed end of the tilt cylinder 23; a tilt supply conduit 38 connecting tilt valve 34 to a tilt blocking valve 40 which is connected through a conduit 41 to the rod end of tilt cylinder 23, a lift supply conduit 42 connecting the manual lift valve 33 to a lift blocking valve 44 which is connected through a conduit 45 to the bottom end of lift cylinder 46 of lift jack 21.

Tilt blocking valve 4o is normally held open by its operating coil 47 which is energized during normal material handling operations, thereby permitting the truck operator to tilt mast 18 forward by operating tilt valve 34 to supply pressurized fluid from pump 32 to the closed end of tilt cylinder 23 through conduit 36 and force fluid out of the rod end of tilt cylinder 23 through conduit 41. When operating coil 47 of blocking valve 40 is de-energized, valve 40 closes so that check valve 49 prevents discharge of fluid from the rod end of tilt cylinder 23 through conduit 41, thereby disabling the mast tilting motor and inhibiting it from further forward tilting of mast 18, but check valve 49 permits the operator to supply pressurized fluid from pump 32 to the rod end of the tilt cylinder 23 through conduit 41 and thereby actuate the mast tilting motor to decrease the forward tilt of mast 18. However, check valve 49 may become clogged due to accumulation of dirt and thus prevent the operator from decreasing forward tilt of the mast.

Lift blocking valve 44 is normally held open by its operating coil 50 which is energized during material handling operations, thereby permitting the operator to raise carriage 12 by supplying pressurized fluid through valves 33 and 44 in series and conduit 45 to the bottom end of lift cylinder 46, or to lower carriage 12 by exhausting fluid from cylinder 46. When operating coil 50 is de-energized, lift blocking valve 44 closes so that check valve 52 blocks supply of pressurized fluid to the bottom end of lift cylinder 46, thus disabling the carriage elevating motor from raising carriage 12 but permitting the truck operator to lower the load 31 under control of manual valve 33. However, check valve 52 may also become inoperative due to clogging.

The safety system for preventing excessive tilting moment on the truck may include four resistance strain gages G1, G2, G3, G4 mounted externally on tilt anchor pin 24 and arranged in a full bridge electrical circuit SGB. Strain gage bridge SGB derives a strain signal proportional to the mechanical strain in pin 24, and a differential operational amplifier DA shown schematically raises the level of the strain signal output from bridge SGB, as disclosed in aforementioned U.S. Pat. No. 4,003,487. A comparator COMP shown in block form receives the output of differential amplifier DA and derives a trip signal when the strain signal reaches a predetermined magnitude indicating that excessive overturning moment in acting on the truck.

The output from comparator COMP is applied to the data input of a shift register SR shown in block form which also receives a train of clock pulses from an oscillator OSC as a time reference and records the history of the output of comparator COMP over a period of time, i.e.; whether the trip signal caused by excessive tilting moment has existed for a period of time. The data accumulated in shift register SR is analyzed in a decoder DEC that sets a latch LATCH shown in block form which, in response thereto, generates a disable logic O signal. The disable signal from the LATCH is coupled through a voltage follower amplifier FA to the base of an NPN base drive transistor Q1 of an operating coil drive amplifier DA to thereby turn Q1 off. This turns off NPN power transistor Q2 which is connected in series with the paralleled operating coils 47 and 50 between the positive terminal B+ and negative terminal B− of a battery BATT carried by the truck, thereby de-energizing operating coils 47 and 50 of blocking valves 40 and 44 respectively to prevent further raising of load support carriage 12 and also preventing further tilting of mast 18 in the forward direction.

Transistors Q1 and Q2 are connected in Darlington arrangement with the emitter-collector circuit of Q2 in series with the paralleled operating coils 47 and 50 and the battery BATT. Under normal material handling conditions, the output of the LATCH is logical one which maintains Q2 in conduction so that coils 47 and 50 are continuously energized to hold blocking valves 40 and 44 open and thus permit pressurized fluid from pump 32 to be supplied respectively to the rod end of tilt cylinder 23 and to the bottom end of lift cylinder 46. Diodes D10 and D9 connected respectively between the coils 50 and 47 and the collector of Q2 isolate the blocking valve operating coils. Diodes D8 and D7 connected in shunt respectively to operating coils 50 and 47 provide paths for free-wheeling of solenoid currents when the overload protective means is operated to turn off Darlington driver transistor Q1.

Under certain material handling conditions the overload protective system disclosed in aforementioned U.S. Pat. No. 4,003,487 may operate to de-energize coils 47 and 50 and thus prevent further shifting of load support carriage 12 in a direction which would increase the forward tilting moment, but the operator may be unable to remove the overload and restore the truck to normal material handling operations. Check valve 49 should permit backward (or decreased forward) tilting of mast 18 when tilt blocking valve 40 is closed and check valve 52 should permit lowering of carriage 12 when lift blocking valve 44 is closed, but such check valves 49 and 52 may become inoperative due to being clogged with dirt. Further, an overload may be picked up when mast 18 is tilted backward and trips the overload protective system to turn off Q2 and close blocking valves 40 and 44, thereby disabling the carriage raising means and making it impossible for the operator to restore the truck to material handling conditions until a second truck is utilized to relieve the overload. Even if the load such as 31 is not excessive, such load may cause excessive overturning moment on the truck if load 31 is picked up at the tips of the forks 19 and actuate the protective system to turn off Q2 and close blocking valves 40 and 44, and under such conditions the mast 18 cannot be tilted forward to relieve the overload even if the carriage 12 is at its lowermost position (since forward tilting is inhibited by blocking valve 40).

The truck overload protective system embodying the invention has overload relieving means which permits the truck operator to remove an overload and reset the truck to normal material handling operation under such conditions wherein it was impossible with the system disclosed in U.S. Pat. No. 4,003,487. Such overload relieving means preferably includes a pressure switch PS having a set of normally closed contacts connected respectively to grounded negative battery B− and to one side of operating coil 47. Switch PS operates to open its contacts in response to pressure in lift cylinder 46 when load supporting carriage 12 is raised. When carriage 12 is lowered to adjacent its lowermost position on mast 18, the decrease in pressure in lift cylinder 46 causes the contacts of pressure switch PS to close, thus re-energizing operating coil 47 and causing blocking valve 40 to open (even when Q2 is turned off) to thereby override the means to disable the mast tilting motor. Opening of blocking valve 40 permits the truck operator to exhaust fluid under the control of tilt control valve 34 from the rod end of tilt cylinder 23 and thus tilt the mast 18 forward to relieve the overload and reset the safety system. It will be appreciated that such forward tilting of mast 18 can be accomplished even if check valve 49 is clogged and inoperative. Once mast 18 is returned to the vertical, the overturning moment decreases so the magnitude of strain signal from strain gage SGB decreases, and comparator COMP removes the trip signal to reset the LATCH and permit Q2 to turn on, thereby resetting the overload protective system and restoring the truck to normal material handling conditions.

The overload relieving means may also permit selective manual override of the means for disabling the carriage elevating motor. Such manual override of the closed position of blocking valve 44 may be accomplished by a LIFT BYPASS push button switch having one stationary contact connected to grounded negative battery B− and the other stationary contact connected to one side of operating coil 50 for blocking valve 44. It will be apparent that depression of LIFT BYPASS switch will energize operating oil 50 to open blocking valve 44 (even if Q2 is turned off) and thus permit the truck operator to exhaust fluid from lift cylinder 46 and lower carriage 12 under the control of valve 33, and it will also be appreciated that such lowering of carriage 12 is accomplished by blocking valve 44 rather than by the check valve 52, so that manual override of the means for disabling the carriage elevating motor can be accomplished even if check valve 52 is clogged.

The overload relieving means may also permit selective manual override of the means for disabling the mast tilting motor. A TILT BYPASS switch may have one contact connected to negative battery B− and the other stationary contact connected to one side of coil 47. Depression of the TILT BYPASS switch will energize coil 47 to open blocking valve 40 and thus permit the truck operator to exhaust fluid from the rod end of tilt cylinder 23 to straighten the mast, and thus relieve an overload, even if check valve 49 is clogged.

While only a single embodiment of our invention has been illustrated and described, many modifications and variations thereof will be readily apparent to those skilled in the art, and consequently it should be understood that we do not intend to be limited to the particular embodiment shown and described.

The embodiments of the invention in which an exclusive property or privilege is claimed are defined as follows:

1. In a lift truck having a tilting mast, a load supporting carriage, a hydraulic mast tilting motor, a hydraulic carriage elevating motor, a load carrying member subjected to the force exerted by ssid mast tilting motor and resisting the overturning moment acting on said truck, said overturning moment being dependent upon the elevation of said carriage, the weight of the load on the carriage, and the angle of inclination of said mast, strain gage sensor means for sensing the mechanical strain in said load carrying member and for generating a tilting-moment signal whose magnitude is a function of said strain, comparator means for deriving an overload signal when said tilting moment signal reaches a predetermined magnitude indicating that said overturning moment acting on said truck is excessive, disabling means coupled to the output of said comparator means and including a normally conducting semiconductor switch and being responsive to said overload signal for inhibiting said carriage elevating motor from raising said carriage and for also inhibiting said mast tilting motor from tilting such mast further forward, said disabling means including tilt and lift electrically operated blocking valves associated with said mast tilting motor and with said carriage elevating motor respectively and each of which has an electric operating coil in series with said semiconductor switch and normally is held in open position wherein fluid can flow to and from the associated motor and being actuated to closed position, when said semiconductor switch is turned off in response to said overload signal, wherein flow of fluid in a direction to increase the forward overturning moment on said truck is blocked, overload relieving means including an electrical switch connected in an electrical circuit with said electric operating coil of said tilt blocking valve and being closed in response to said carriage being adjacent its lowermost position on said mast for completing an electrical energizing circuit to said operating coil of said tilt blocking valve to actuate it to open position, and manually operated overload relieving electrical switch means for selectively completing an electrical energizing circuit to said electric operating coil of said lift blocking valve to actuate it to open position.

* * * * *